United States Patent [19]

Moss

[11] 4,004,509

[45] Jan. 25, 1977

[54] MOUNTING-PROOFING MACHINE

[75] Inventor: Lester I. Moss, Hackensack, N.J.

[73] Assignee: Mosstype Corporation, Waldwick, N.J.

[22] Filed: Aug. 1, 1975

[21] Appl. No.: 601,057

[52] U.S. Cl. ..... 101/216; 33/184.5; 101/248; 101/DIG. 12

[51] Int. Cl.[2] ..... B41F 17/00; B41F 13/16; B41F 13/44

[58] Field of Search ..... 101/212, 216, 219, 248, 101/426, DIG. 12; 33/184.5

[56] References Cited

UNITED STATES PATENTS

| | | | |
|---|---|---|---|
| 2,539,965 | 1/1951 | Moss et al. | 101/216 |
| 3,057,292 | 10/1962 | Larsen | 101/248 |
| 3,186,336 | 6/1965 | Kirby | 101/216 |
| 3,331,318 | 7/1967 | Augnstyn et al. | 101/247 |
| 3,361,060 | 1/1968 | Hoexter et al. | 101/247 |
| 3,390,633 | 7/1968 | Boughton | 33/184.5 |
| 3,398,633 | 8/1968 | Raivio | 33/184.5 |
| 3,679,316 | 7/1972 | Boujon | 101/DIG. 12 |

FOREIGN PATENTS OR APPLICATIONS

| | | | |
|---|---|---|---|
| 2,305,264 | 8/1973 | Germany | 101/DIG. 12 |

*Primary Examiner*—Edgar S. Burr
*Assistant Examiner*—William Pieprz

[57] ABSTRACT

A mounting-proofing machine to facilitate mounting of flexible printing plates on a plate cylinder preparatory to operation in a flexographic printing press and to obtain proofs from these plates, whereby the mounted plates may be checked for color registration and other factors. The machine includes a proofing cylinder cantilevered from and rotatable on the free end of a swing arm adapted to transfer the proofing cylinder from a forward-position proofing state in which it makes contact with the surface of a plate cylinder that has been elevated in a vertical plane intersecting the axes of rotation of both cylinders to effect such engagement, to a rear-position mounting state displaced from this plane. In the mounting state, an optical viewer adapted to observe the surfaces of both cylinders in superposed relation is brought into an operative position which is intersected by the vertical plane. In the course of its swing, the proofing cylinder is caused to undergo an angular displacement to an extent whereby a point printed on the proofing cylinder in the proofing state and corresponding to a contact point on the plate cylinder is phase-shifted to assume an observation position in the mounting state which, in the optical viewer, appears to be coincident with the contact point.

12 Claims, 9 Drawing Figures

MOUNTING-PROOFING MACHINE

BACKGROUND OF INVENTION

This invention relates generally to machines to facilitate the mounting of rubber printing plates and for obtaining proofs thereof, and more particularly to a mounting-proofing machine of exceptionally simple design capable of handling plate cylinders in a large range of diameters.

In the flexographic process, printing is effected by rubber printing plates mounted on cylinders, the paper to be printed being impressed on the inked printing plate. The cylinder on which the printing plates are mounted is generally called the plate cylinder. The quality of a flexographic printing job depends, in large measure, on the care with which pre-press preparations are carried out. Plate-mounting, color registration and proofing are effected off the press by means of commercially available mounting-proofing machines designed for this purpose.

These machines, which usually make use of an optical mounting system, make it possible to mount the plates on plate cylinders to effect exact color-registration, a procedure essential to the maintenance of both quality and economy in all flexographic operations. Pre-proofing is, in many respects, the most important of all pre-press preparations, for it not only indicates the appearance of the final reproduction, but it also affords means to check the mounting of the plates for color sequence, spacing requirements, layout and gear size, as well as copy and color separation.

Mounting-proofing machines are provided with a proofing cylinder (sometimes called the impression cylinder) which cooperates with the plate cylinder, the proofing cylinder making contact with the printing plates on the plate cylinder and rotating concurrently therewith to print a proof on a sheet secured to the proofing cylinder. In commercial machines of the type heretofore known which make use of optical mounting techniques, the proofing or impression cylinder is supported for rotation at a fixed position, whereas the plate cylinder is movable, usually in the vertical direction, from a mounting state in which it is retracted relative to the proofing cylinder to a proofing state in which it is in engagement therewith.

The proofing and plate cylinders are mechanically intercoupled, whereby rotation of the proofing cylinder causes the plate cylinder to rotate. When the diameter of the proofing cylinder is the same as the printing diameter of the plate cylinder (i.e., the diameter of the plate cylinder plus the thickness of the printing plates thereon), then a one-to-one relationship exists therebetween.

But since in practice the plate cylinders come in a range of diameters for printing different print lengths, it has heretofore been necessary to adjust the phase relationship between the plate and proofing cylinders to accommodate the differences between the cylinder diameters. For adjusting this phase relationship for different plate cylinder diameters, a relatively complex mechanism is required in existing types of mounting-proofing machines.

Another drawback of existing types of mounting-proofing machines is their limited capacity to handle plate cylinders of different diameter. With machines of the type heretofore known, the capacity of the machine is restricted to a range of plate cylinder diameters extending from about 95 percent of the diameter of the proofing cylinder down to about 25 or 30 percent thereof, or approximately 4 to 1. Moreover, since in existing structures, the proof forces imposed at contact are eccentrically-opposed the structures required to accommodate these magnifield forces are too large to permit smaller sizes of plate cylinders to fit the machine.

SUMMARY OF INVENTION

In view of the foregoing, the main object of this invention is to provide a mounting-proofing machine of simple and efficient design for accurately and quickly mounting and proofing flexible printing plates on a plate cylinder preparatory to operation in a flexographic printing press.

While not limited to any particular application, a machine in accordance with the invention is especially useful in effecting plate positioning and color registration on a broad range of plate cylinders of the type commonly employed in narrow web printing as well as in tape and label printing applications.

More specifically, it is an object of the invention to provide a machine of the above-type wherein the proofing cylinder is not maintained at a fixed location as in a conventional machine, thereby dictating adjustment of the phase relationship to suit a particular plate cylinder diameter, but is transferred from a forward-position proofing state to a rear-position mounting state, in the course of which the proofing cylinder undergoes an angular displacement and assumes a proper phase angle with respect to the plate cylinder, which angle is the same regardless of the diameter of the plate cylinder.

Thus a major advantage of the present invention is that the mounting-proofing machine requires but a single phase angle proofing cylinder displacement in conjunction with plate cylinders in a broad range of diameters, thereby dispensing with the need for complex phase-angle adjustment mechanisms.

Also an object of this invention is to provide a machine of the above-type which, in the proofing state, causes the plate cylinder to approach the proofing cylinder on a direct-line within a vertical plane intersecting the horizontal axes of rotation of both cylinders, whereby the proofing forces imposed at contact are aligned with the approach path, thereby subjecting the cylinder structures to direct loads rather than to magnified eccentric loads, as in the case of conventional machines.

Still another object of this invention is to provide a mounting-proofing machine capable of handling a broad range of plate cylinders from about 95 percent of the diameter of the proofing cylinder to as little as 5 percent of this diameter, whereby the plate cylinder handling capacity of the machine is far greater than that of existing machines.

Briefly stated, these objects are attained in a mounting-proofing machine in which the proofing cylinder is cantilevered from and rotatable on the free end of a swing arm adapted to transfer the proofing cylinder from a forward-position proofing state to a rear-position mounting state. The plate cylinder, which is provided with a drive gear at one end thereof, is supported for rotation on an elevator beam adapted to vertically raise the plate cylinder in a plane which intersects the horizontal axes of rotation of both cylinders in the proofing state.

In the proofing state, the free end of the proofing cylinder is coupled to a forward drive shaft which carries the proofing cylinder gear, this gear intermeshing with the drive gear affixed to the corresponding end of the plate cylinder then in contact with the proofing cylinder, whereby rotation of the proofing cylinder causes concurrent rotation of the plate cylinder.

In the mounting state, the free end of the proofing cylinder is coupled to a rear drive shaft, this shaft being operatively coupled by an anti-backlash gear train to the forward drive shaft, whereby rotation of the proofing cylinder in this state again causes rotations of the forward drive shaft which carries the proofing cylinder gear and results in concurrent rotation of the plate cylinder.

In swinging from the proofing state to the mounting state on the swing arm, the proofing cylinder is caused to undergo angular displacement. The extent of this phase shift is such that a point printed on the proofing cylinder in the proofing state and corresponding to the point of contact on the plate cylinder assumes an observation point position which appears to be coincident with the contact point on the plate cylinder in an optical viewer adapted in the mounting state to afford superposed views of the surfaces of both cylinders.

OUTLINE OF DRAWINGS

For a better understanding of the invention as well as other objects and further features thereof, reference is made to the following detailed description to be read in conjunction with the accompanying drawings, wherein:

FIG. 1 schematically illustrates the relationship between a plate cylinder and a proofing cylinder in a mounting-proofing machine in accordance with the invention, in the proofing state in which the plate cylinder is in contact with the proofing cylinder;

FIG. 3 is a perspective view of an actual machine in accordance with the invention as seen looking toward the left side of the machine;

DESCRIPTION OF INVENTION

Schematic Arrangement

Figure 1:
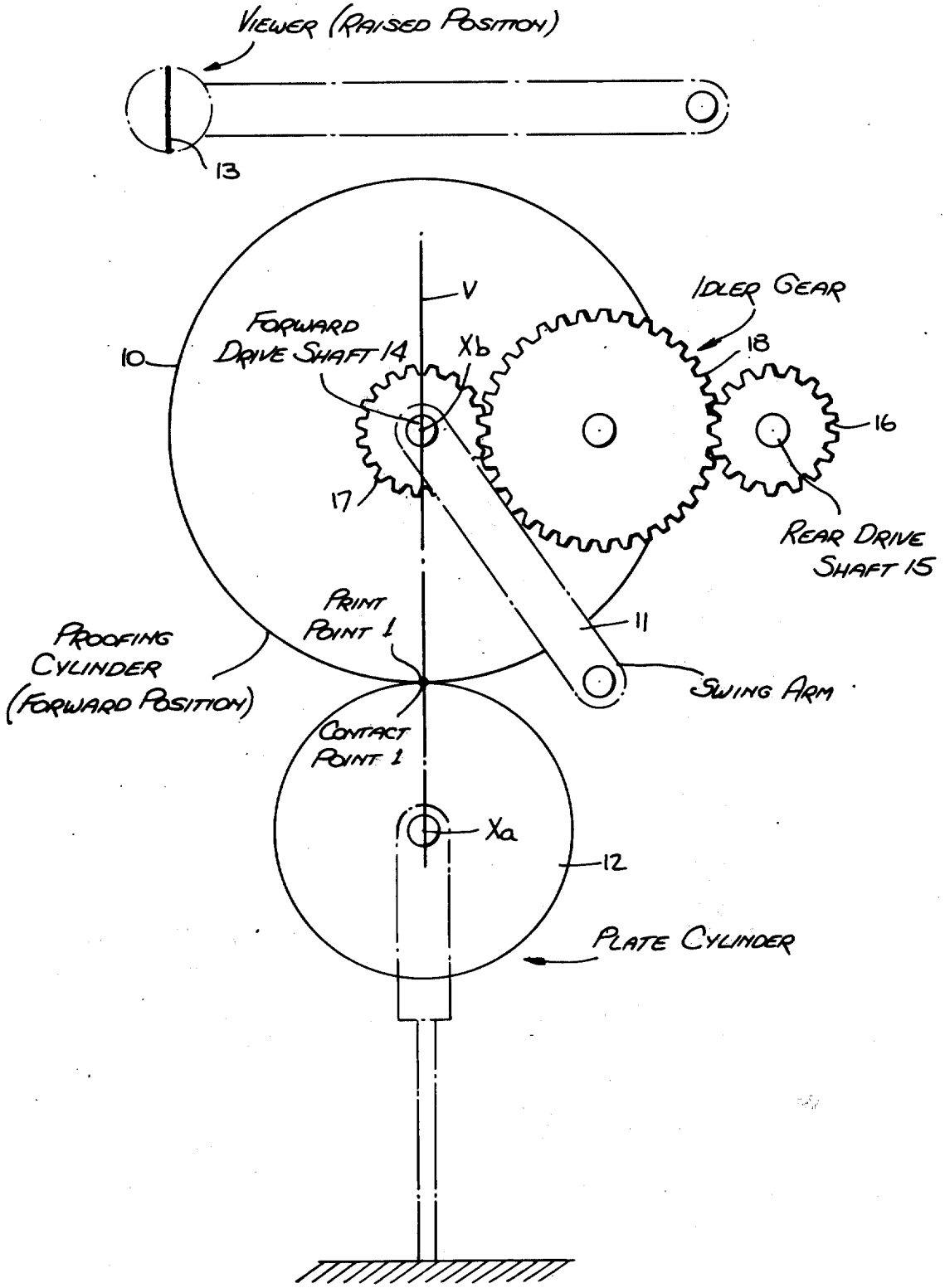
Figure 2:
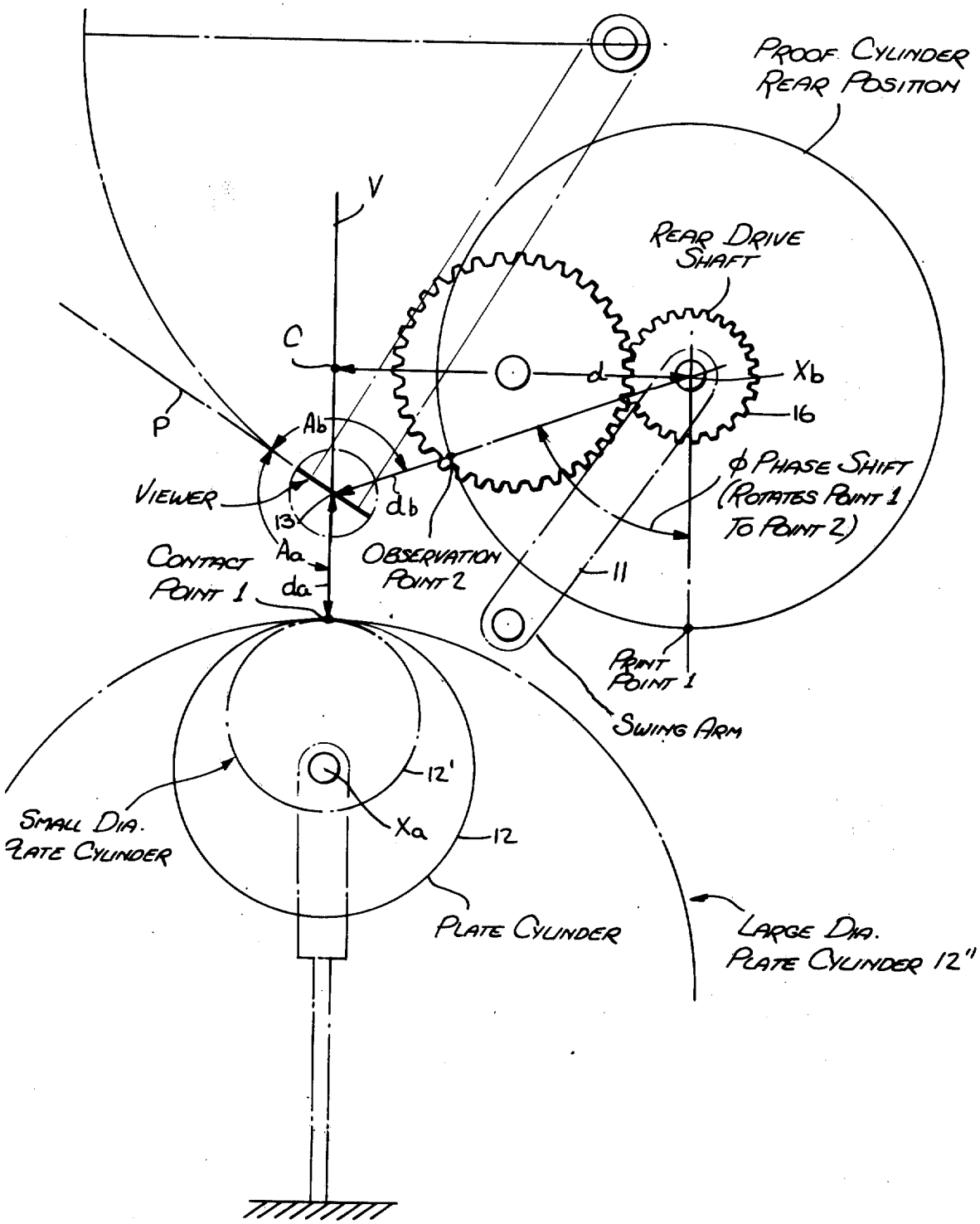
FIG. 2 is the same as FIG. 1, except that in this instance the machine is in the mounting state in which the proofing cylinder is retracted with respect to the plate cylinder.

Referring now to FIGS. 1 and 2, there is schematically shown the main components of a mounting-proofing machine according to the invention, the machine including a proofing cylinder 10 of large diameter cantilevered from and supported for rotation on the free end of a swing arm 11 which is movable within a predetermined arc, whereby the proofing cylinder may be transferred from a forward position in which it is operative in the proofing state with respect to plate cylinder 12 to a rear position in which it functions in the mounting state.

The arrangement is such that the horizontal axis of rotation $X_a$ of plate cylinder 12 as well as the horizontal axis of rotation $X_b$ of proofing cylinder 10 in the forward position both intersect a vertical plane V; hence the centers of the cylinders are then in vertical registration. In the proofing state, plate cylinder 12 is elevated by a supporting beam until it makes peripheral contact with proofing cylinder 10, thereby causing the point of contact 1 on the periphery of the plate cylinder to print a corresponding point 1 on proofing cylinder 10 (hereinafter referred to as print point 1).

In the proofing state shown in FIG. 1, plate cylinder 12 is in contact with proofing cylinder 10 and a retractable viewer 13, which is in the form of an illuminated partial mirror, occupies a raised position above the cylinders in which it is inactive.

In the mounting state in which proofing cylinder 10 occupies its rear position, as shown in FIG. 2, its horizontal axis $X_b$ is horizontally displaced from its proofing state center C on vertical plane V by a distance $d$. In the mounting state, viewer 13, which is pivotally mounted, is swung down from its inactive position to an operative position. At this position, the plane $p$ of the mirror is inclined relative to vertical plane V, the point of intersection O between the plane of the mirror and vertical plane V being midway between center C and contact point 1 on plate cylinder 10.

With the viewer mirror so oriented, one is able to see therein both the surface of the proofing cylinder and the surface of the plate cylinder, these surfaces appearing in superposed relation. In order to obtain coincidence between these views, it is essential that print point 1 impressed on proofing cylinder 10 when in the proofing state be angularly displaced so that it is shifted to an observation point 2 in the mounting state. This angular displacement of the proofing cylinder from print point 1 to observation point 2 is represented by phase shift $\phi$.

It is important to note that the required phase shift $\phi$ is independent of the diameter of the plate cylinder, for whether the plate cylinder has the diameter of cylinder 12 or that of a cylinder 12′ of smaller diameter or that of a cylinder 12″ of larger diameter, contact point 1 on the plate cylinder is always at the same point, and the required phase shift from print point 1 on the proofing cylinder to observation point 2 thereon remains unchanged.

Viewer 13 is so placed that the distance represented by line $d_b$ between point O on its mirror and observation point 2 on proofing cylinder 10 is equal to the distance represented by line $d_a$ between point O and contact point 1 on plate cylinder 12. Line $d_b$ is normal to the tangent of the surface of proofing cylinder 10, while line $d_a$ is normal to the tangent of the surface of plate cylinder 12. Consequently, angle $A_b$ between plane $p$ of the mirror and line $d_b$ is exactly equal to angle $A_a$ between plane $p$ and line $d_a$, so that in the viewer mirror, contact point 1 on the plate cylinder appears to be coincident with observation point 2 on the proofing cylinder.

The required phase shift $\phi$ is effected by swing arm 11 which transfers proofing cylinder 10 from its forward to its rear position. Before this swing takes place, the proofing cylinder, which is rotatable on the swing arm, must be locked against rotation, so that as the arm swings through a predetermined arc, the print point 1 on the proofing cylinder is angularly displaced, and the proofing cylinder, in effect, undergoes epicyclic rotation to a degree exactly equal to the required phase shift. This equality is the result of the simultaneous solution for the proper values of the length of the swing arm 11, the position of its pivot point, the length of its travel arc, the distances $d_a$ and $d_b$ and the angles $A_a$ and $A_b$.

In order to provide concurrent rotation of the proofing and plate cylinders in both the mounting and proofing states, the free end of the proofing cylinder whose other end is cantilevered on the swing arm, is engaged in the proofing state by a retractable forward drive shaft 14 which carries the proofing cylinder gear (to be later shown). When, therefore, proofing cylinder 10 is rotated, the proofing gear on the forward drive shaft 14 is caused to turn, this gear intermeshing with a correspondingly-positioned gear on the plate cylinder then in contact with the proofing cylinder, thereby causing concurrent rotation of the plate cylinder.

Before transferring the proofing cylinder from its forward to its rear position, the forward drive shaft 14 is retracted to free the proofing cylinder, and after transfer is effected, the proofing cylinder is engaged by a retractable rear drive shaft 15. In order, in the mounting state, to cause concurrent rotation of both cylinders, rear drive shaft 15 is operatively coupled by a gear train to the forward drive shaft, so that when the proofing cylinder is rotated at its rear position, the resultant rotation of the rear drive shaft brings about rotation of the forward drive shaft which carries the proofing cylinder gear, thereby causing concurrent rotation of the plate cylinder. An anti-backlash gear train for this purpose is constituted by a gear 16 mounted on rear drive shaft 15, a gear 17 mounted on the forward drive shaft 14 and an idler gear 18 intercoupling gears 16 and 17, so that the rotation of the rear drive shaft is transmitted to the forward drive shaft. In the machine, when drive shafts 14 and 15 are simultaneously retracted prior to transfer of proofing cylinder 10 from one state to another, the gear train is at the same time locked to prevent rotation of the plate cylinder, thereby retaining the exact position of contact point 1 thereon.

The Actual Machine

Referring now to FIGS. 3 to 9, an actual machine in accordance with the invention is illustrated for mounting-proofing plate cylinders in a broad range of different diameters, the machine including proofing cylinder 10 and plate cylinder 12. In FIG. 3, the plate cylinder illustrated is one of small diameter, whereas in FIG. 4 the plate cylinder is of relatively large diameter.

Printing plate cylinders for narrow web flexographic printing as well as in tape and label printing applications are commonly constructed with a plate cylinder drive gear 19 directly affixed to the right end face thereof. The cylinder is provided with bushings at either end (no journals). The cylinder is mounted on a fixed axle in the printing press, the cylinder rotating on this axle.

In the mounting-proofing machine, the plate cylinder is held on its axle ends between a pair of axle supports 20 and 21, which are adjustable on the ways of an elevator beam 22, so that the horizontal spacing between the supports may be set to accommodate the particular width of the cylinder then in place.

Elevator beam 22 is supported and rides on threaded vertical posts 23 and 24, which are simultaneously raised or lowered by an elevator mechanism 25 and 26, which engages the threads of the posts. These jack screws are hand-operated by a rotatable rod 27. In practice, the elevator mechanism may be hydraulically-operated to raise and lower the plate cylinder, as required, into contact with the proofing cylinder in the vertical plane which intersects the horizontal axes of rotation of both cylinders.

When the plate cylinder is raised in the proofing state to make contact with the proofing cylinder, its drive gear 19 intermeshes with a proofing cylinder gear 28 which is carried by forward drive shaft 14, the gears intermeshing tightly enough to run smoothly but without backlash. This adjustment fixes the height or position of the plate cylinder printing surface, and a common point for all plate cylinders is established.

Figure 9:
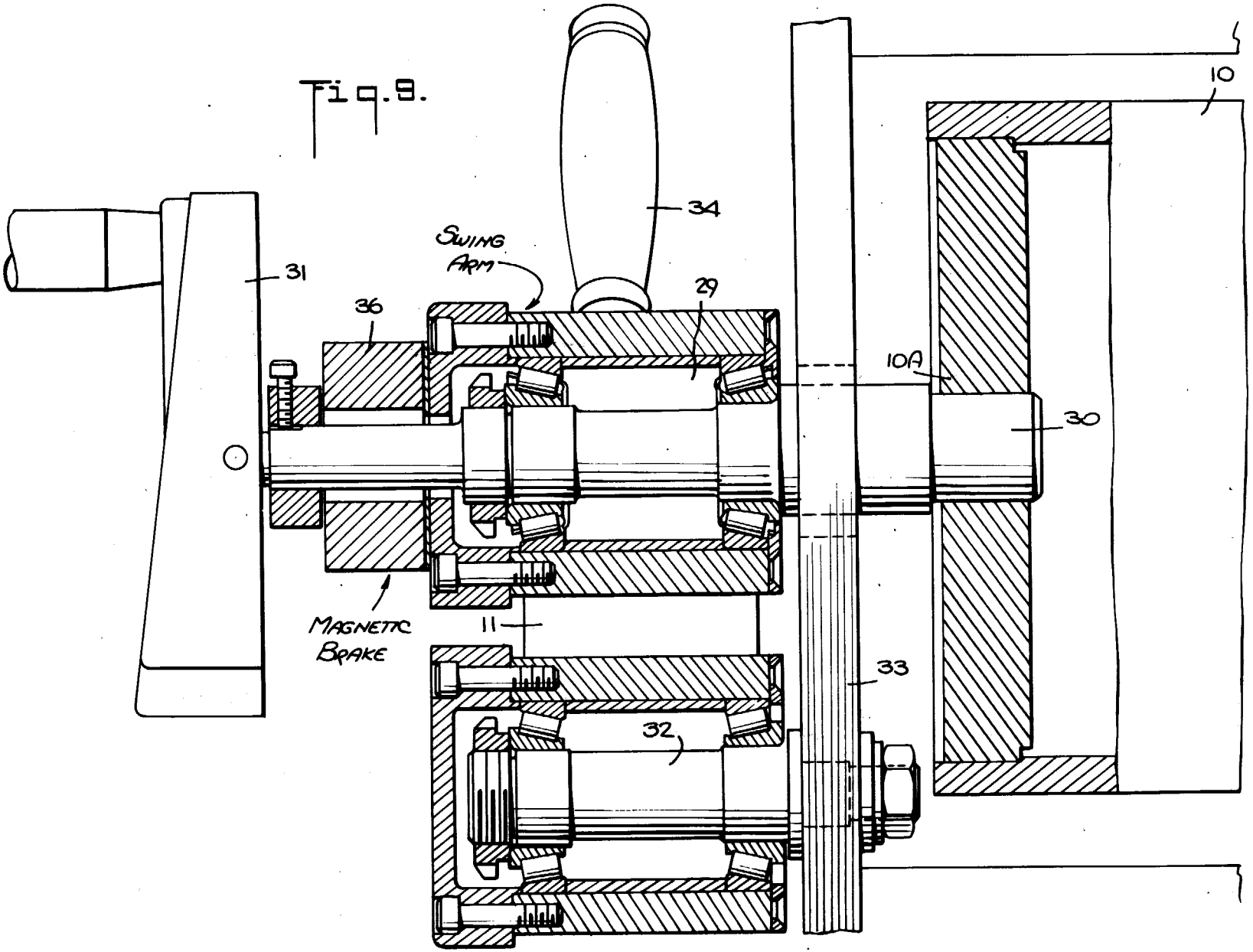
FIG. 9 is a detail showing the manner in which the proofing cylinder is supported on the swing arm therefor.

Proofing cylinder 10, as best seen in FIG. 9, is supported in cantilevered fashion on swing arm 11 from a bearing 29 at its left-hand journal 10A, through which bearing is extended a stub shaft 30 terminating in a crank handle 31. Thus by turning this handle, one is able manually to rotate proofing cylinder 10. Bearing 29 is installed at the free end of swing arm 11 whose lower end is pivotally supported by a bearing 32 mounted on the left-hand side frame 33 of the machine.

An upwardly-extending handle 34 is provided on the free end of swing arm 11, so that the proofing cylinder may be manually shifted in an arc from its proofing to its mounting state. In order to lock the position of the proofing cylinder against rotation when such transfer is effected, an electromagnetic brake 36 is provided which, when electrically energized, locks stub shaft 30 to swing arm 11. In practice, this locking action may be carried out mechanically rather than electromagnetically. It will be appreciated that the manual operations described herein may be carried out hydraulically or by suitable motors.

Figure 8:
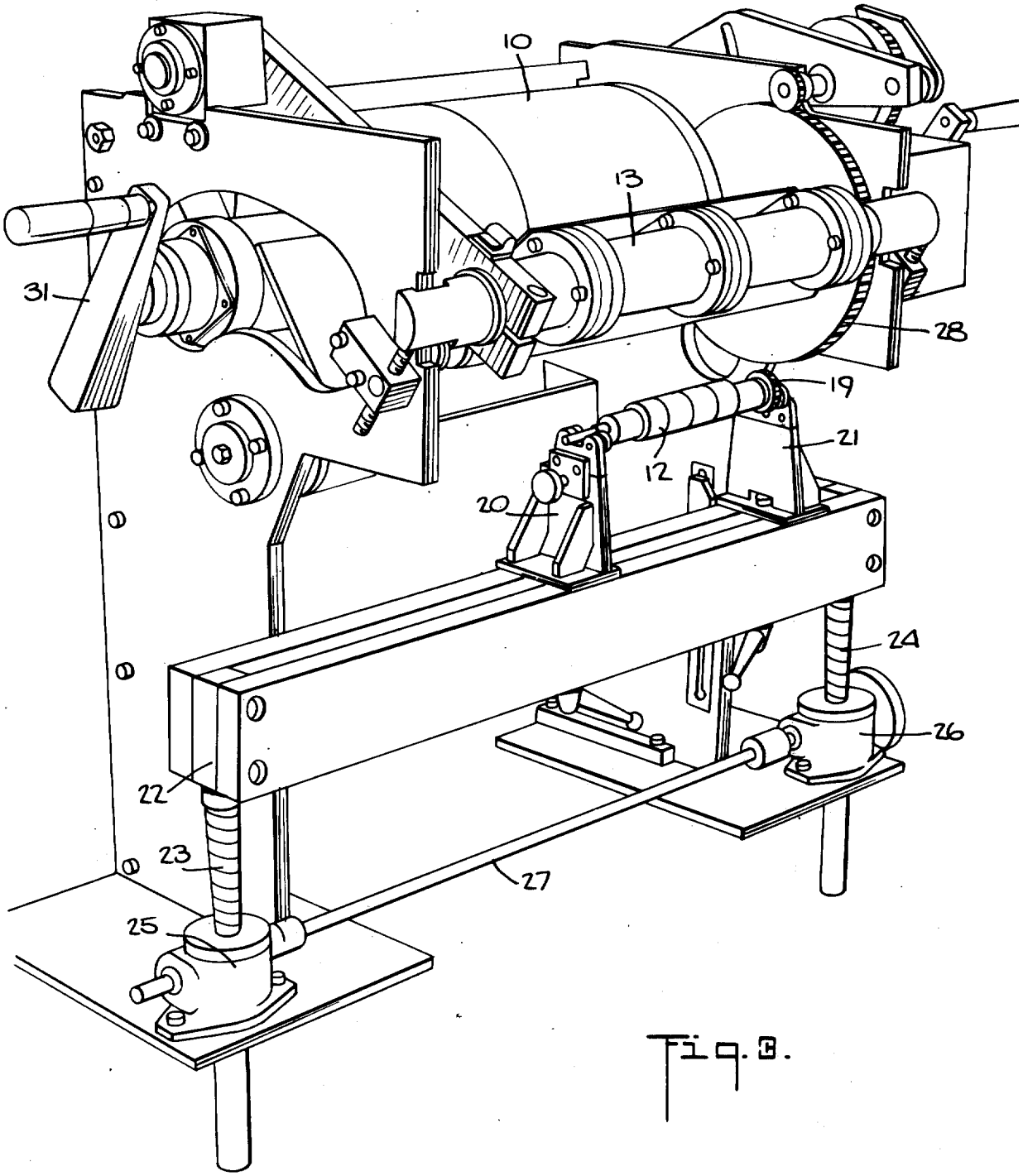
FIG. 8 is a detail illustrating the forward and rear drive shafts for the proofing cylinder and the gears cooperating with these shafts.
Figure 4:
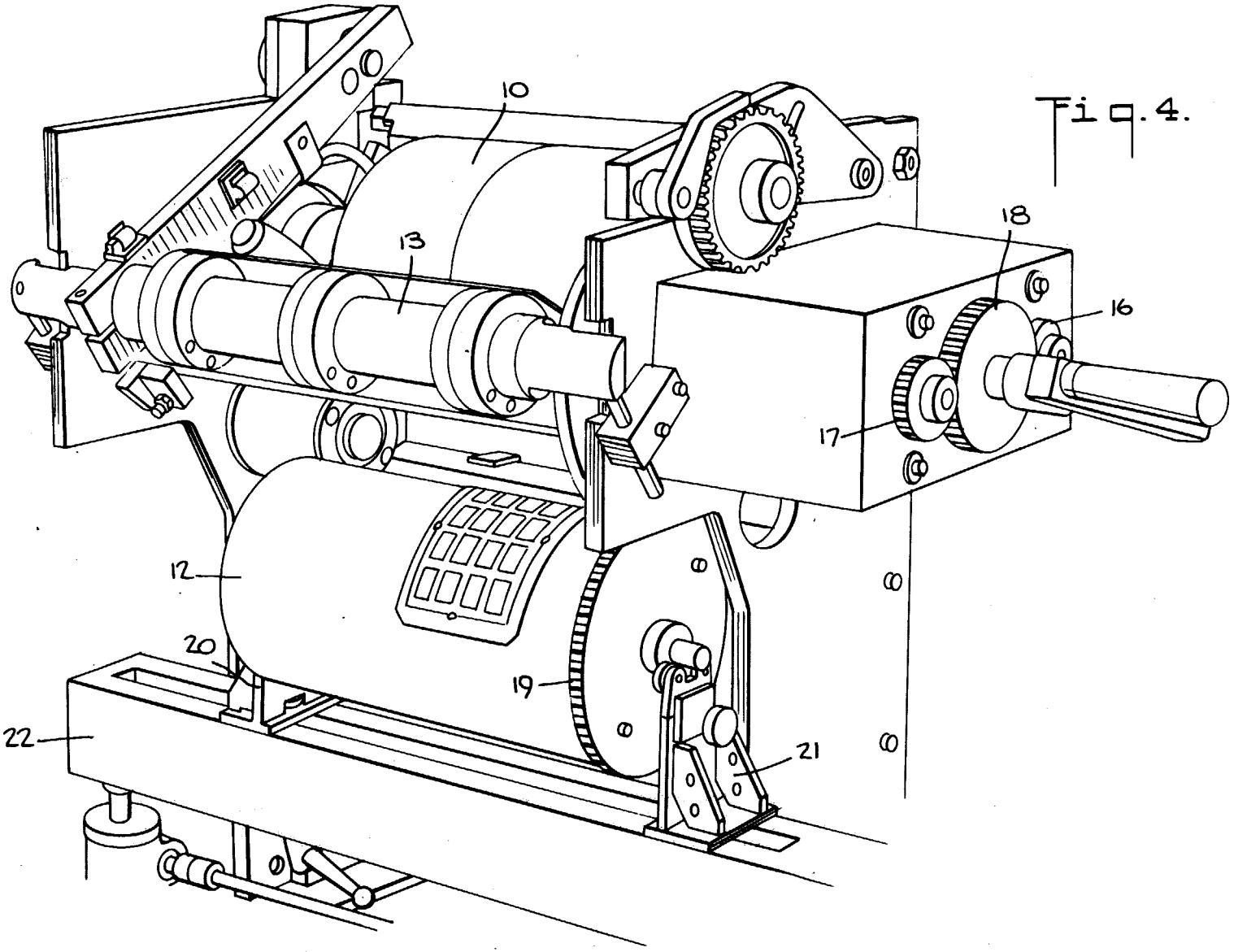
FIG. 4 is a perspective view of the same machine as seen looking toward the right side thereof.
Figure 5:
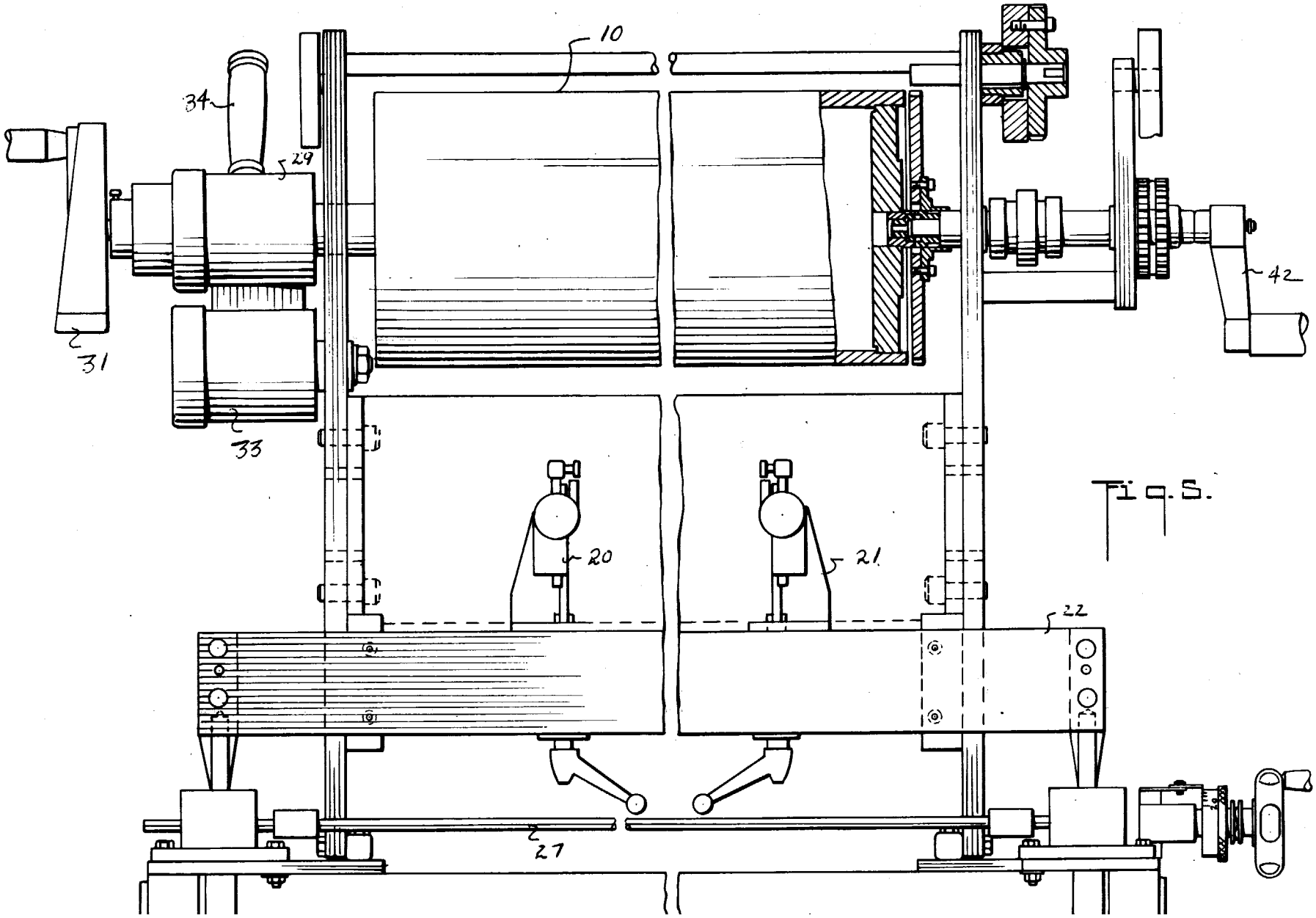
FIG. 5 is a front elevation of the machine.
Figure 6:
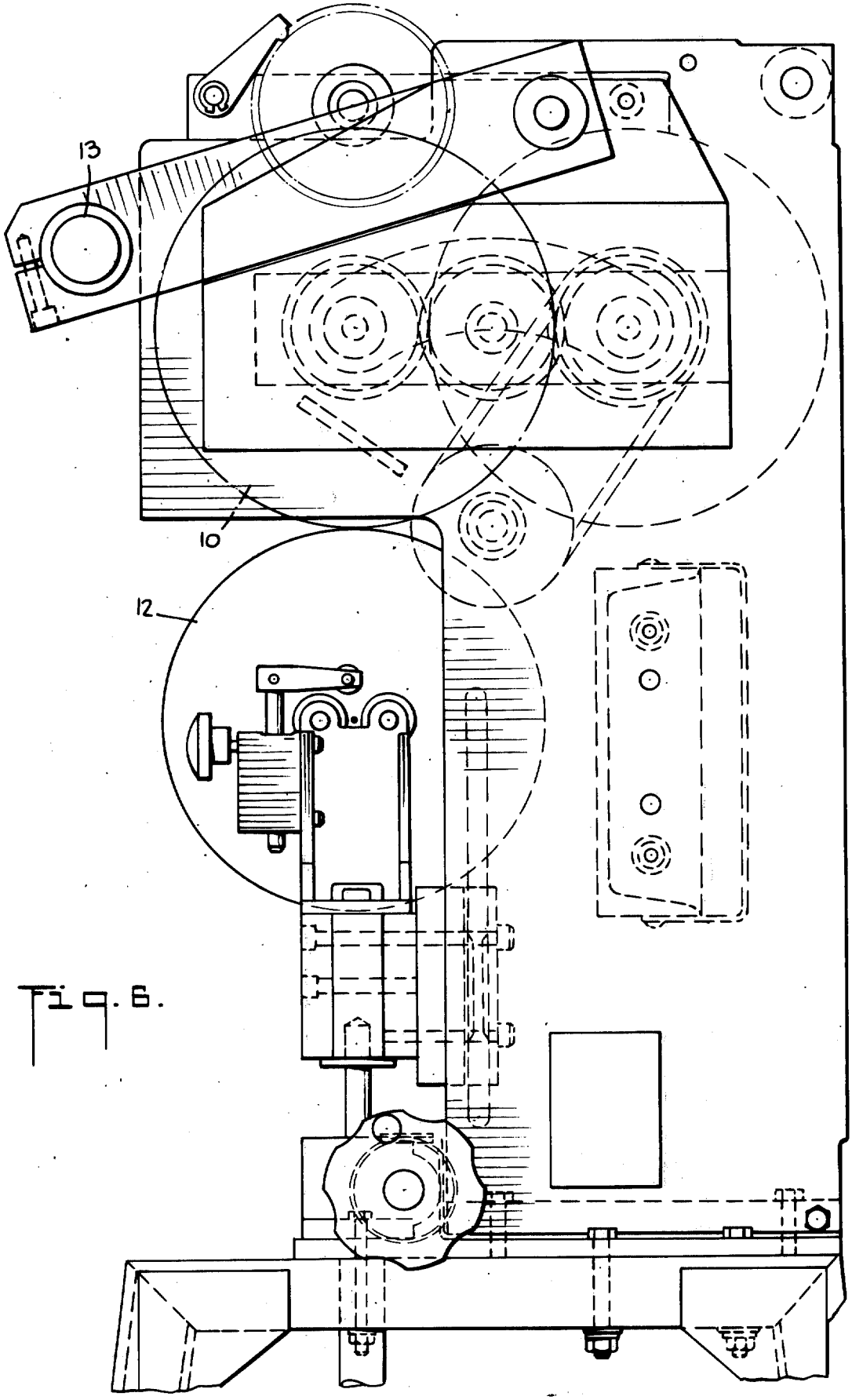
FIG. 6 is a right-side elevation of the machine.
Figure 7:
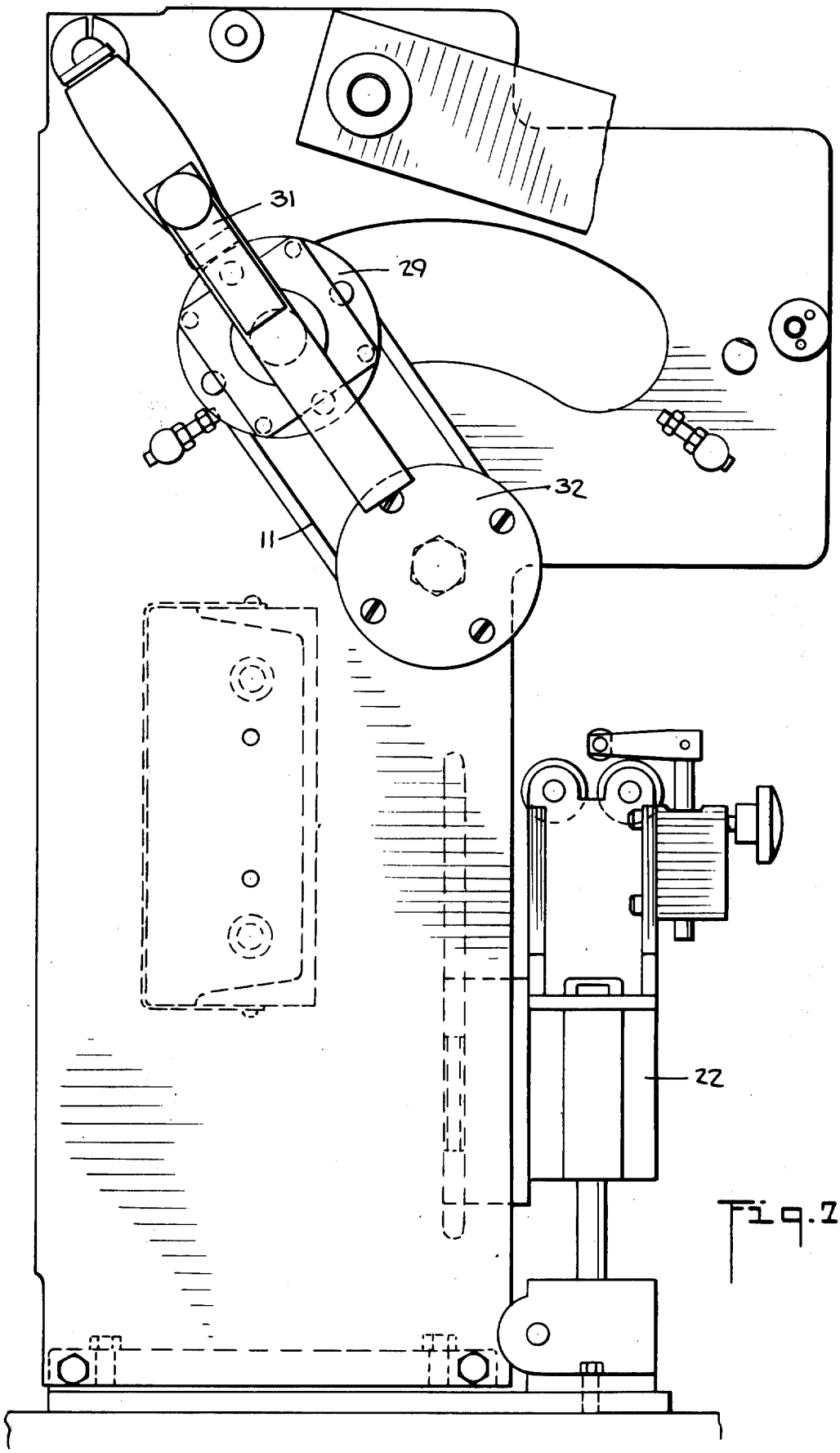
FIG. 7 is a left-side elevation of the machine.
Figure 8:
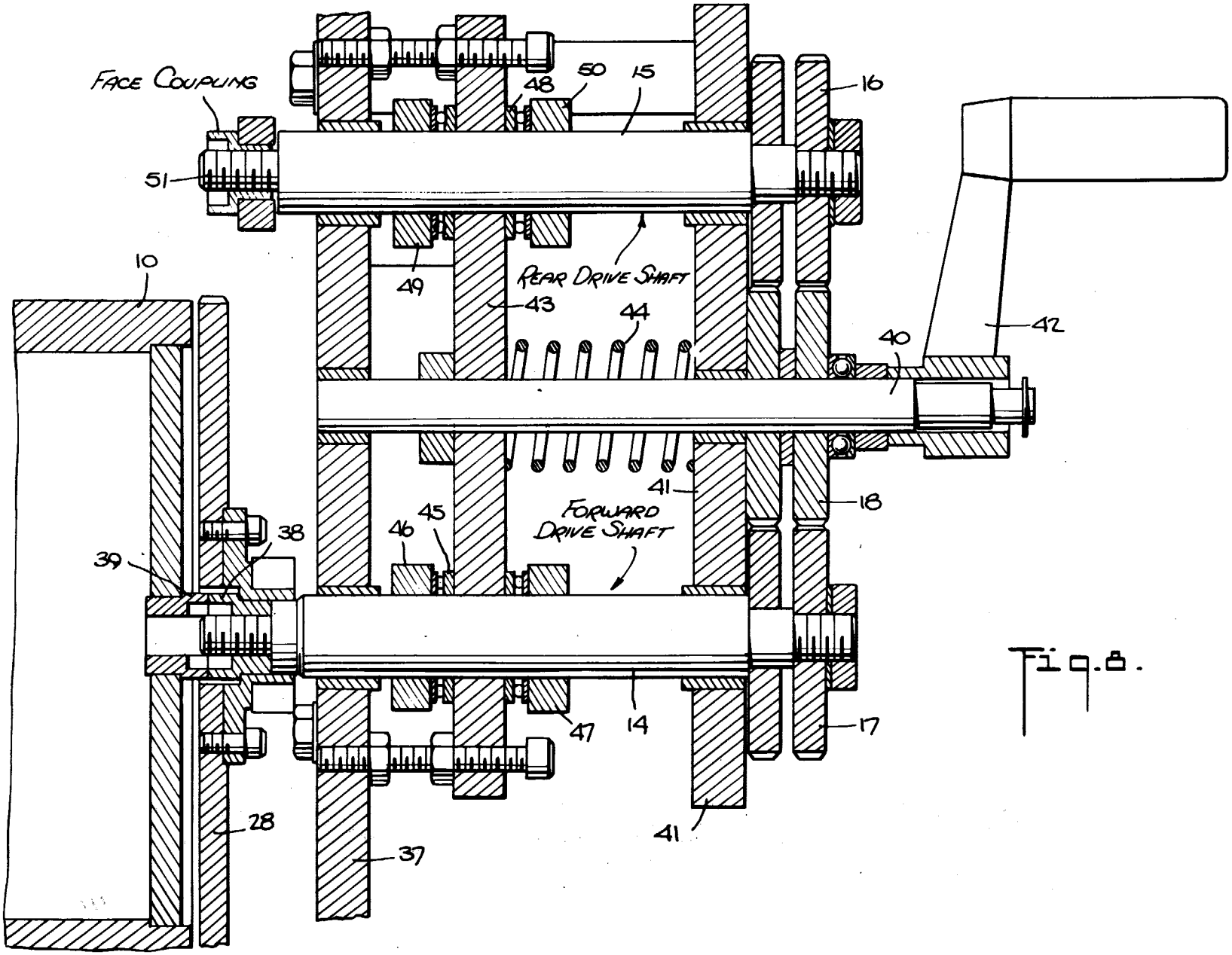

At its forward or proofing position, the free, right-hand face of proofing cylinder 10, as shown in FIG. 8, is adjacent to proofing cylinder gear 28. This arrangement is similar to the relationship existing between the plate cylinder and its drive gear 19. However, proofing cylinder gear 28 is not affixed to the proofing cylinder, as in a conventional mounting-proofing machine, but is borne on forward drive shaft 14, which is journaled in the right-hand side frame 37 of the machine, the right end of this shaft terminating in gear 17 of the three-gear train.

The left-hand face of forward drive shaft 14 is provided with a face coupling 38 which mates with a complementary coupling 39 on the proofing cylinder. Half of this coupling is secured concentrically to the free or right-hand end of the proofing cylinder and the matching half is secured concentrically to the forward drive shaft.

In addition to effecting a positive and non-backlash connection, the face gear coupling assures the concentricity and rigidity of the right-hand end of the proofing cylinder. This is fully as effective as a carefully-fitted shafted proofing cylinder supported at both ends, thereby overcoming the disadvantages that would normally attend a single-ended support.

When proofing cylinder 10 occupies its forward position and the forward drive shaft 14 is engaged therewith, the machine operates in its proofing state, and rotation of the proofing cylinder gives rise to concurrent rotation of the plate cylinder 12, whereby a print is transferred from the printing plate mounted on the plate cylinder to a proof sheet on the proofing cylinder. Thereafter, proofing cylinder 10 is locked, forward drive shaft 14 is retracted, after which proofing cylinder 10 is transferred by swing arm 11 to its rear or mounting state.

At this point, rear drive shaft 15 is brought into engagement by means of a face coupling 51 with the free end of proofing cylinder 10 to provide rigid support for this end. Rear drive shaft 15, through the three-gear train (16, 17 and 18) is operatively coupled to proofing gear 28, so that when the proofing cylinder is turned in the mounting state, concurrent rotation of the plate cylinder is effected.

In order to effect simultaneous engagement and disengagement of the forward and rear drive shafts from the free end of proofing cylinder 10, a long screw 40 or threaded shaft is provided, as shown in FIG. 8, this screw 40 passing through a bore on the right-hand side frame 41 of the machine at a position intermediate the bores therein receiving forward drive shaft 14 and rear drive shaft 15.

Screw 40 terminates at the right in a crank handle 42, the screw passing through idler gear 18. Rotation of screw 40 in one direction acts to pull a cross bar 43 against a helical compression spring 44 surrounding the screw. The resultant displacement of the cross bar acts to retract both forward drive shaft 14 and rear drive shaft 15. Forward drive shaft 14 extends through a thrust bearing 45 in cross bar 43 and is linked to the bar by a pair of locking collars 46 and 47 placed on either side of this bearing. Likewise, rear drive shaft 15 extends through a thrust bearing 48 in the cross bar and is linked thereto by locking collars 49 and 50.

When screw handle 42 is turned to retract the forward and rear shafts with respect to the proofing cylinder, it also exerts screw pressure on idler gear 18, thereby forcing this gear against frame 41 and locking the gear train to prevent rotation of the plate cylinder as well as rotation of the shafts 14 and 15.

SUMMARY AND ADVANTAGES

The operation of the machine shall now be summarized. In the proofing state, proofing cylinder 10, which is cantilevered on swing arm 11, occupies a forward position in which its center of rotation and the center of the plate cylinder brought into contact therewith both intersect a common vertical plane. The proofing cylinder, in this state, is engaged at its free end by forward drive shaft 14 carrying proofing cylinder gear 18 which itermeshes with drive gear 19 of the plate cylinder, whereby rotation of the proofing cylinder results in concurrent rotation of the plate cylinder to effect printing of a proof.

Because the cylinders approach the proofing contact position in a common vertical plane intersecting the centers of both cylinders, the cylinder structures are subjected to direct loads, rather than eccentric loads as in prior machines wherein the approach path is not in a plane common to both centers.

Before transferring from the proofing state to the mounting state, electromagnetic brake 36 is actuated to lock proofing cylinder 10 to the swing arm therefor, thereby maintaining the position of the proofing cylinder. Long screw 40 is then cranked to retract both drive shafts, thereby freeing the swing arm and at the same time locking the idler gear against its adjacent frame to prevent rotation of the plate cylinder.

Then, by means of the handle on swing arm 11, proofing cylinder 10 is swung into its rear position and viewer 13 is brought down into its operative position, the machine now being in its mounting state wherein the printing plates on the plate cylinder and a proof thereof taken on the proofing cylinder will appear to be superimposed in the viewer, coincidence between these views being the result of a predetermined phase shift in the angular position of the proofing cylinder in the course of its transfer from the proofing to the mounting state.

The general procedure in using this machine preparatory to multi-color press operation is as follows: A plate cylinder intended for press operation is installed on the elevator beam. In the mounting state, printing plates are mounted on the plate cylinder by means of the viewer which makes it possible to check the position of the plates against a layout secured to the proofing cylinder. Once a set of plates is properly in position on the plate cylinder, the viewer is retracted and the proofing cylinder is transferred from its rear to its forward position, in which proofing state a proof is taken on the proof sheet secured to the proofing cylinder, the plates being inked for this purpose.

The proofing cylinder is then returned to its rear position and in the mounting state the printing plates for the next color are mounted on a new plate cylinder, so that the image of the next color is superimposed in the viewer upon the image of the proof on the proofing cylinder. A print of the completed second color is then proofed upon the proofing cylinder by bringing the proofing cylinder forward to the proofing state. At this stage, the proof will show the first and second colors printed in register. The third and subsequent colors are completed by repeating the same procedure.

Among the significant features of the machine are the following:

A. The necessary phase shift of the proofing cylinder is automatically effected by transferring the proofing cylinder on the swing arm from which it is cantilevered from its forward to its rear position, the same phase shift being operative for the full range of plate cylinder diameters. This obviates the need for an adjustable phase shift as in existing machines, or a device to change the angle of the viewer.

B. The proofing forces through the plate and proofing cylinder structures are in direct line rather than eccentric relationship, thereby making it feasible to fit smaller diameter plate cylinders into the machine.

C. Because of features A and B, the capacity of the machine to handle plate cylinders of different diameters is enlarged, making possible a range of plate cylinder diameters from about 95 percent to about 5 percent of the proofing cylinder diameter in a ratio of 19 to 1, as against the 4 to 1 capacity of existing machines.

While there has been shown and described a preferred embodiment of a mounting-proofing machine in accordance with the invention, it will be appreciated that many changes and modifications may be made therein without, however, departing from the essential spirit thereof.

I claim:

1. A mounting-proofing machine to facilitate mounting of flexible printing plates on a plate cylinder preparatory to operation in a flexographic printing press and to obtain proofs from these plates, said machine comprising:

A. a proofing cylinder rotatable about a horizontal axis and means to transfer the proofing cylinder from a forward-position proofing state in which it makes contact with the surface of the plate cylinder to a rear-position mounting state in which it is displaced from the plate cylinder;

B. a retractable viewer which in the mounting state is adapted to observe the surfaces of both cylinders in superposed relation; and C. elevator means supporting said plate cylinder on an axle for rotation about a horizontal axis and adapted to raise said plate cylinder in a vertical plane which intersects the horizontal axis of the plate cylinder and the horizontal axis of the proofing cylinder in its forward position, said transfer means including a mechanism causing said proofing cylinder to undergo an angular displacement to an extent at which a point printed on the proofing cylinder in the proofing state and corresponding to the point of contact on the plate cylinder assumes an observation point in the mounting state, which in said optical viewer appears to be coincident with the contact point.

2. A machine as set forth in claim 1, wherein said transfer means mechanism is constituted by a swing arm which is movable through a predetermined arc, said proofing cylinder being cantilevered from the free end of said arm.

3. A machine as set forth in claim 1, further including means mechanically intercoupling said cylinders in both the proofing and in the mounting state, whereby rotation of said proofing cylinder in either state causes concurrent rotation of the plate cylinder.

4. A machine as set forth in claim 2, wherein said proofing cylinder is supported at one end on a stub shaft extending through a bearing on the free end of said arm, said shaft terminating in a crank handle whereby said proofing cylinder may be manually rotated.

5. A machine as set forth in claim 4, further including means coupled to said stub shaft to lock said shaft to said arm to prevent rotation of said proofing cylinder about its horizontal axis of rotation in the course of said transfer.

6. A machine as set forth in claim 3, wherein said means mechanically intercoupling said cylinders includes a drive gear affixed to said plate cylinder, a retractable forward drive shaft adapted to engage the free end of the proofing cylinder in its forward position and carrying a proofing cylinder gear which, when the cylinders are in contact, intermeshes with said drive gear, whereby rotation of said proofing cylinder rotates said forward drive gear and causes rotation of said plate cylinder.

7. A machine as set forth in claim 6, further including a retractable rear drive shaft adapted to engage the free end of the proofing cylinder in its rear position and rotatable therewith, and a gear train intercoupling said forward and rear shafts.

8. A machine as set forth in claim 7, wherein said gear train is constituted by a first gear secured to said rear drive shaft, a second gear secured to said forward drive shaft, and an idler gear intercoupling said first and second gears.

9. A machine as set forth in claim 8, further including means to lock said idler gear to prevent rotation of said plate cylinder in the course of said transfer.

10. A machine as set forth in claim 7, wherein simultaneous retraction of said forward and rear drive shafts is effected by a cross bar linked to both shafts and an extended screw passing through said cross bar to pull both shafts.

11. A machine as set forth in claim 1, wherein said elevator means is constituted by a beam having a pair of supports thereon for holding the axle ends of the plate cylinder, said supports being adjustable along said beam to accommodate plate cylinders of different widths.

12. A machine as set forth in claim 1, wherein said viewer includes a partial mirror whose plane intersects said vertical plane in said mounting state.

* * * * *